US010093010B2

(12) United States Patent
Chiasson et al.

(10) Patent No.: US 10,093,010 B2
(45) Date of Patent: Oct. 9, 2018

(54) MULTI-STAGE HYDRAULIC TOOL

(71) Applicant: Hubbell Incorporated, Shelton, CT (US)

(72) Inventors: Mark A. Chiasson, Merrimack, NH (US); Michael P. Rzasa, Nashua, NH (US); George R. Bitter, Mesa, AZ (US)

(73) Assignee: Hubbell Incorporated, Shelton, CT (US)

( * ) Notice: Subject to any disclaimer, the term of this patent is extended or adjusted under 35 U.S.C. 154(b) by 631 days.

(21) Appl. No.: 14/680,784

(22) Filed: Apr. 7, 2015

(65) Prior Publication Data

US 2015/0283693 A1 Oct. 8, 2015

Related U.S. Application Data

(60) Provisional application No. 61/976,447, filed on Apr. 7, 2014.

(51) Int. Cl.

| | |
|---|---|
| ***B25F 5/00*** | (2006.01) |
| ***B25B 27/14*** | (2006.01) |
| *H01R 43/042* | (2006.01) |

(52) U.S. Cl.

CPC ..... *B25F 5/005* (2013.01); *B25B 27/146* (2013.01); *H01R 43/0427* (2013.01)

(58) Field of Classification Search

CPC .... B25F 5/005; B25B 27/146; H01R 43/0427
USPC ..... 173/218
See application file for complete search history.

(56) References Cited

U.S. PATENT DOCUMENTS

| | | | | |
|---|---|---|---|---|
| 3,030,838 | A * | 4/1962 | Klingler | H01R 43/0427 72/432 |
| 3,070,143 | A * | 12/1962 | Klingler | B21J 15/22 137/463 |
| 3,612,114 | A | 10/1971 | Pawloski | |
| 4,136,549 | A * | 1/1979 | Lytle | H01R 43/0427 29/751 |
| 4,458,418 | A | 7/1984 | McSmith et al. | |
| 4,689,957 | A | 10/1987 | Gallentine | |
| 4,942,757 | A | 7/1990 | Pecora | |
| 5,058,272 | A | 10/1991 | Steube | |

(Continued)

FOREIGN PATENT DOCUMENTS

| | | |
|---|---|---|
| WO | 0162452 | 8/2001 |

OTHER PUBLICATIONS

PCT/US2015/24725 International Search Report and Written Opinion dated Jul. 8, 2015.

*Primary Examiner* — Michelle Lopez
(74) *Attorney, Agent, or Firm* — Michael Best & Friedrich, LLP

(57) ABSTRACT

A hydraulic tool includes a handle having a trigger, a tool head, a tool body, a pump, a first actuator, a second actuator, and a conduit. The tool head has a first jaw and a second jaw. The tool body includes a first portion, an extension, and a second portion positioned between the handle and the tool head. The pump is activated by the trigger to displace a first fluid. The first actuator is moveable by the displacement of the first fluid to displace a second fluid. The second actuator is moveable by the displacement of the second fluid to cause movement of at least one of the first and second jaws. A conduit provides fluid communication between the first actuator and the second actuator.

18 Claims, 6 Drawing Sheets

(56) References Cited

U.S. PATENT DOCUMENTS

| | | | |
|---|---|---|---|
| 5,284,044 | A | 2/1994 | Bier |
| 5,344,506 | A | 9/1994 | Deangelis |
| 5,381,686 | A | 1/1995 | Thorup |
| 5,425,164 | A | 6/1995 | El Dessouky |
| 5,974,646 | A | 11/1999 | Cotter |
| 6,000,680 | A | 12/1999 | Kimura et al. |
| 6,070,449 | A | 6/2000 | Vachon |
| 6,092,290 | A | 7/2000 | Vogelsanger |
| 6,212,932 | B1 | 4/2001 | Parker |
| 6,666,064 | B2 | 12/2003 | Lefavour et al. |
| 7,032,429 | B1 | 4/2006 | McDougle |
| 7,464,578 | B2 | 12/2008 | Ayer et al. |
| 7,926,321 | B2 | 4/2011 | Rollins et al. |
| 8,176,636 | B2 | 5/2012 | Bush |
| 8,308,757 | B2 | 11/2012 | Hillstead et al. |

* cited by examiner

MULTI-STAGE HYDRAULIC TOOL

CLAIM TO PRIORITY

This application is based on provisional application Ser. No. 61/976,447, filed Apr. 7, 2014, the disclosure of which is incorporated herein by reference in its entirety and to which priority is claimed.

FIELD

Various exemplary embodiments relate to hand held hydraulic tools.

BACKGROUND

Many electric utilities employ metal conductor overhead electrical wires for the distribution of electricity. For example, Aluminum or copper conductor cables may be used. One type of conductor that may be used is a commonly used ACSR cable that includes a bare, steel reinforced, aluminum cable. Accordingly, there is a need, among other needs, for relatively more versatile conductor tools that provide for portable, extended reach and provide for reliable, easy to use conductor manipulation such as for crimping or cutting at a relatively long distance from the operator of the tool.

SUMMARY

In an exemplary embodiment, a hydraulic tool includes a pump, a first actuator, and a second actuator. The pump displaces a first fluid. The first actuator is moveable by the displacement of the first fluid to displace a second fluid. The second actuator is moveable by the displacement of the second fluid to cause activation of a tool head.

In another exemplary embodiment, a hydraulic tool includes a handle having a trigger, a tool head for performing an operation, a pump, a first actuator and a second actuator. The pump is activated by the trigger to displace a first fluid. The first actuator is moveable by the displacement of the first fluid to displace a second fluid. The second actuator is moveable by the displacement of the second fluid and operatively connected to the tool head.

In another exemplary embodiment, a tool includes a handle having a trigger, a first actuator, a tool head, an extension, and a second actuator. The first actuator is operatively connected to the trigger. The extension is positioned between the handle and the tool head. The second actuator is operatively connected to the first actuator and to the tool head.

In another exemplary embodiment, a hydraulic tool includes a handle having a trigger, a tool head, a tool body, a pump, a first actuator, a second actuator, and a conduit. The tool head has a first jaw and a second jaw. The tool body includes a first portion, an extension, and a second portion positioned between the handle and the tool head. The pump is activated by the trigger to displace a first fluid. The first actuator is moveable by the displacement of the first fluid to displace a second fluid. The second actuator is moveable by the displacement of the second fluid to cause movement of at least one of the first and second jaws. A conduit provides fluid communication between the first actuator and the second actuator.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Various exemplary embodiments are directed to hydraulic tools, for example portable, battery operated hydraulic tools for performing manipulations such as crimping or cutting operations. According to various exemplary embodiments, a first and second stage hydraulic system is formed using a first fluid and a second fluid that are operably connected to one another. In certain embodiments, the force is increased from the first stage t the second stage. Movement of the first fluid causes movement of the second fluid and operation of a tool. In certain illustrative embodiments, the systems and methods described herein are useful for providing extended reach and reliable, easy to use tools capable of operations or manipulations such as placement, movement, crimping, or cutting. The system can be incorporated in a tool that allows an operation to be performed at a relatively long distance from the operator of the tool.

Figure 1:
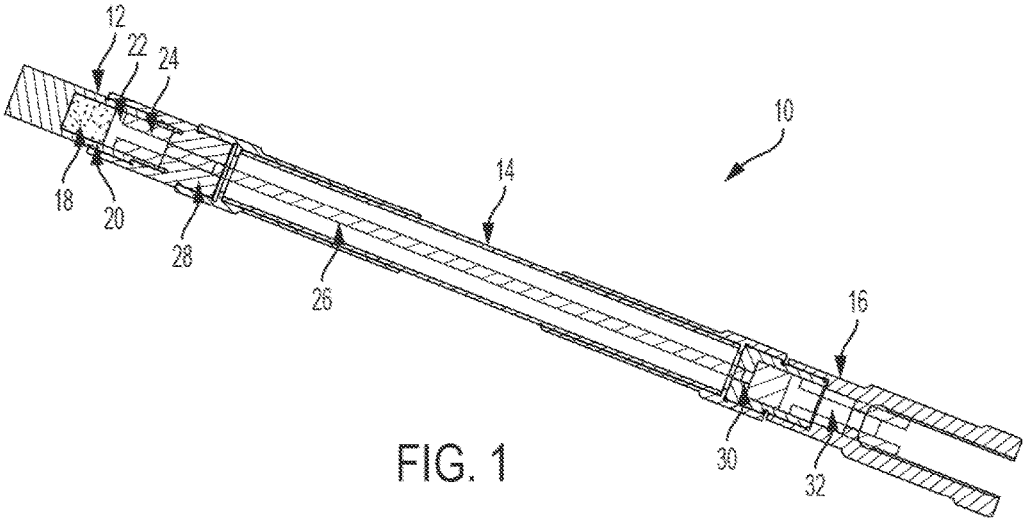
FIG. 1 is a schematic representation of a first and second hydraulic stage in an exemplary tool body.

FIG. 1 depicts a schematic of an exemplary hydraulic tool having a tool body 10 with a pump 12, an extension 14, and a yoke 16. The pump 12 can be a part of a housing (not shown), for example a portable, hand-held housing that can be carried and manipulated by a user. A tool head (not shown) can be connected to the yoke 16 to perform an operation, such as a cutting or crimping operation. Different types of tool bodies 10 can be used with the exemplary embodiments described herein as would be understood by one of ordinary skill in the art.

In an exemplary embodiment, the pump 12 is connected to a power source (not shown), for example a battery or an a/c power source. Various types of batteries can be suitable for use with the tool body 10, including rechargeable batteries. When the pump 12 is activated, it displaces a first fluid 18. The first fluid 18 can be positioned in a first reservoir 20 adjacent, surrounding, or otherwise operably connected to the pump 12.

When the pump 12 displaces the first fluid 18 it moves a first actuator 22. In an exemplary embodiment, the first actuator 22 is a ram that is slidably positioned in a cylinder adjacent the pump 12. In alternative embodiments, other actuators may be used. Displacement of the ram by the first fluid 18 causes movement of a second fluid 24. As shown, the ram can be in contact with the first fluid 18 on a first side and a second fluid 24 on a second side, although other types of operable connections may be used or designed. In certain embodiments, the first fluid 18 and the second fluid 24 are separated or isolated from one another. A seal can be formed between the first fluid 18 and the second fluid 24, for example by the ram and/or through one or more sealing elements positioned adjacent thereto. In an exemplary embodiment, the second fluid 24 is a non-conductive fluid.

In an exemplary embodiment, the second fluid 24 is moved by the first actuator 22 through a conduit 26. The conduit 26 extends from a first portion 28 of the tool body 10 to a second portion 30 of the tool body 10. Various connections or couplings can be used to connect the conduit 26 to the first and second portions 28, 30 of the tool body 10. In certain embodiments, the conduit 26 is a flexible tube, for example a hose, that runs through the extension 14. The conduit 26 can also be positioned outside of the extension 14.

Movement of the second fluid 24 by the first actuator 22 causes movement of a second actuator 32, for example a second ram. Movement of the second actuator 32 can cause movement or actuation of a tool head, for example to perform a crimping or cutting operation. In the exemplary embodiment, the second ram is slidably positioned in a cylinder adjacent the yoke 16. The end of the second ram can be permanently or releasably connected to a tool head, for example by a fastener such as a pin, a twist lock, a threaded, or other suitable connection.

Figure 2:
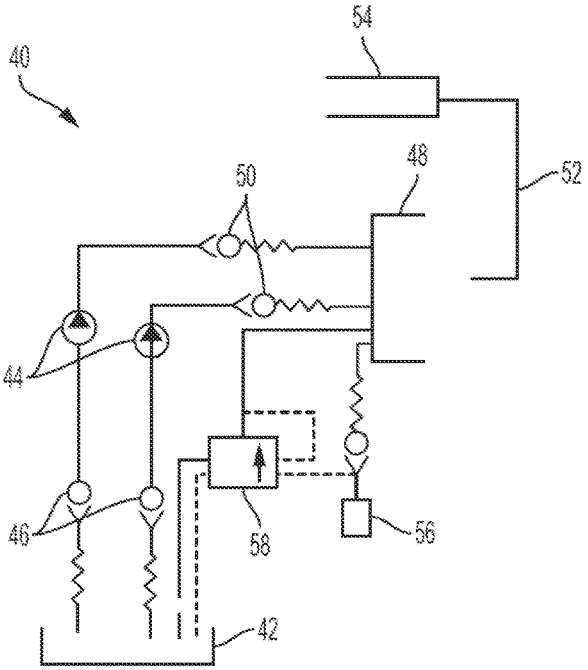
FIG. 2 is a schematic of an exemplary hydraulic system.
Figure 3:
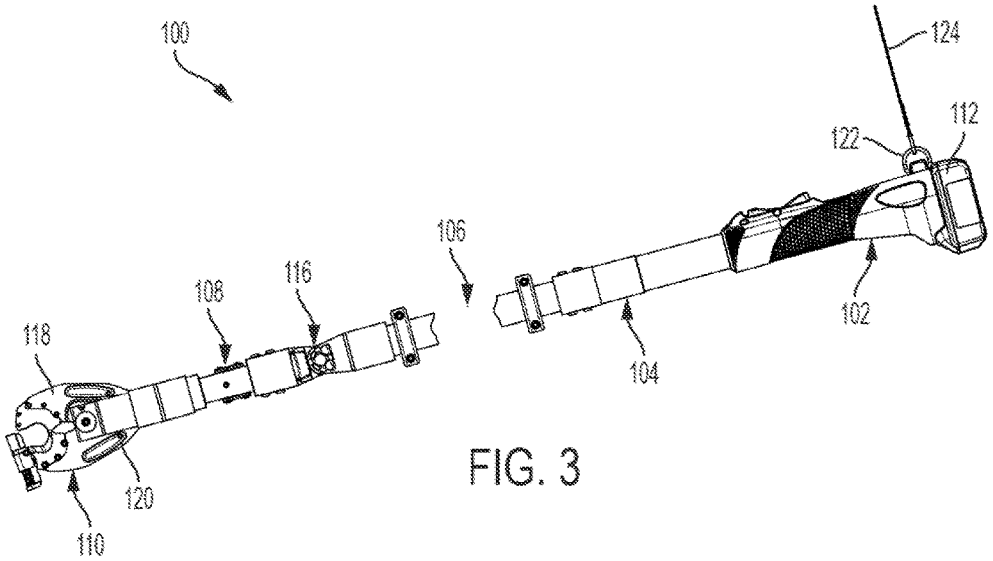
FIG. 3 is a side view of an exemplary hydraulic tool.
Figure 4:
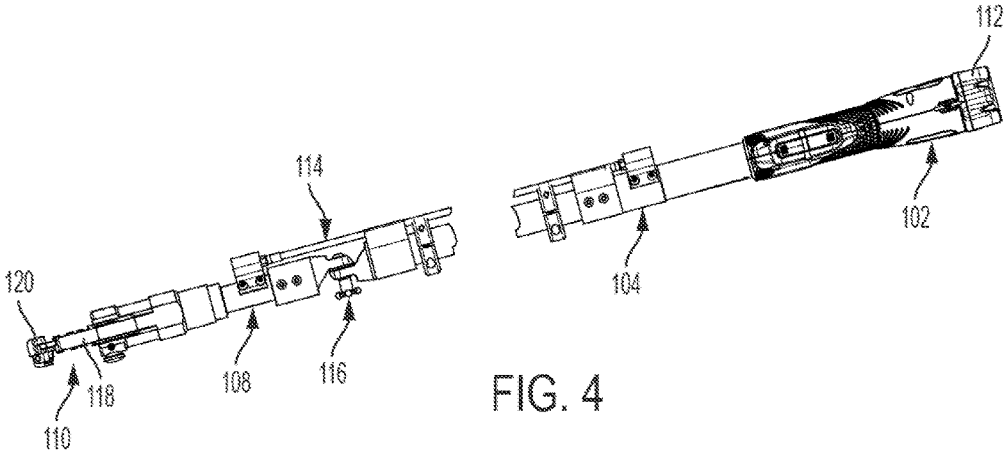
FIG. 4 is a top view of FIG. 3.

FIG. 2 shows a hydraulic system 40 schematic according to another exemplary embodiment. The hydraulic system 40 includes a reservoir 42 and one or more pumps 44, for example two, that are in communication with the reservoir 42. The pumps 44 can be connected to a power source, for example a battery. A first set of valves 46, for example check valves, is positioned between the pumps 44 and the reservoir 42 to prevent unwanted backflow into the reservoir 42. The pumps 44 displace fluid from the reservoir 42 to move a first actuator 48. In the exemplary embodiment, a second set of valves 50, for example check valves, is positioned between the pump 44 and the first actuator 48. Movement of the first actuator 48 displaces a second fluid along a path 52. Displacement of the second fluid causes movement of a second actuator 54. In an exemplary embodiment, the second actuator 54 is connected to a tool head to cause actuation or operation of a tool. The system 40 can also include a drain 56 and a relief valve 58. The drain 56 can be actuated by a user to drain the first fluid back into the reservoir 42, allowing the first actuator 48 to return to its initial position. The relief valve 58 can also be configured to drain the first fluid if a pressure limit is reached or exceeded, or if a cycle is completed.

FIGS. 3-10 show an exemplary embodiment of a hydraulic system incorporated in a hand-held, portable tool 100. The tool 100 includes a handle 102, a tool body having a first portion 104 proximate the handle 102, an extension member 106, and a second portion 108 distal from the handle 102, and a tool head 110. A battery 112 is connected to the handle 102 to provide power to the tool 100. A fluid conduit 114 is positioned between the handle 102 and the tool head 110, for example connected to the first and second portions 104, 108. The tool 100 also includes a pivot member 116, so that the tool head 110 can be rotatably adjusted with respect to the handle 102. In the exemplary embodiment shown, the tool head 102 includes a first jaw 118 and a second jaw 120 that are configured to perform a cutting and/or crimping operation. In alternative embodiments, other types of tool heads 110 can be used. In certain embodiments, the tool head 110 can be removable so that different tool heads 110 can be used with the same body. A ring 122 can also be connected to the handle 102 to attach a flexible strap 124, for example a wrist strap. The tool body can have other configurations and components according to the type of tool and the specific use.

Figure 5:
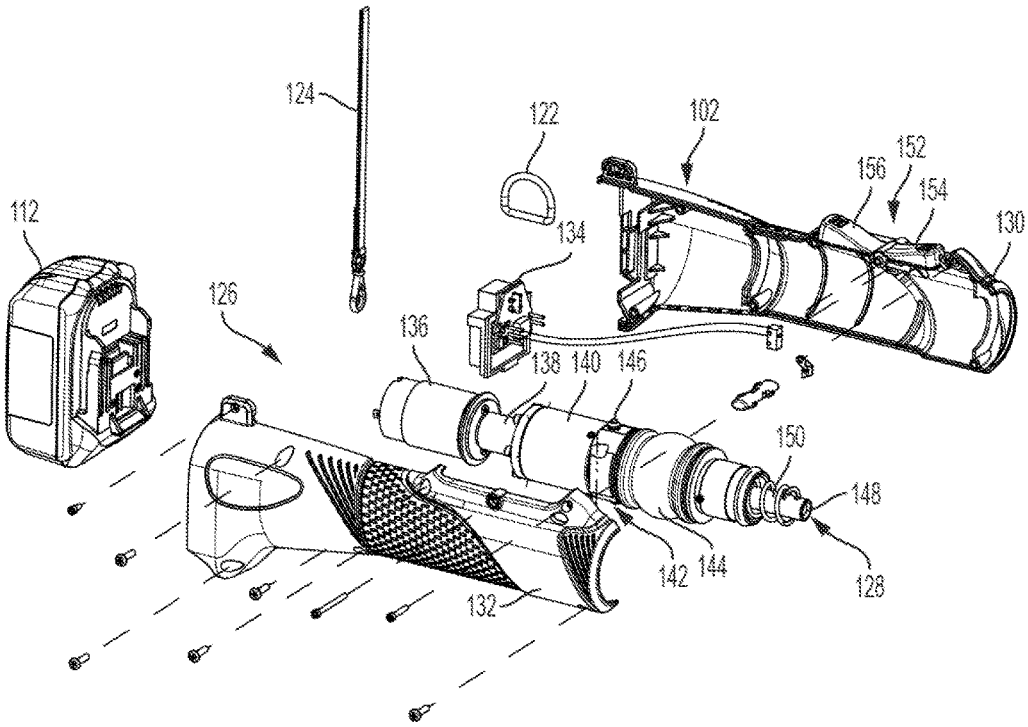
FIG. 5 is a perspective, exploded view of the exemplary tool handle of FIG. 1.

FIG. 5 shows an exemplary embodiment of the handle 102, a pump assembly 126, and first actuator 128 of the exemplary tool 100. The handle includes 102 a first part 130 that is connected to a second part 132 to form a housing for at least a portion of the pump assembly 126. The battery 112 or battery pack is releasably connected to the rear of the housing, for example through a snap fit connection. The battery 112 can be removed to be charged and replaced with another similar or identical type of battery. Examples of suitable rechargeable, removable batteries include lithium ion and nickel metal hydride batteries. A wire harness 134 is retained in the handle 120 and includes one or more contacts that electrically connect with the battery 112. One or more conductors supply power from the battery 112 to the pump assembly 126. Other types of handles or housings can be used as would be understood by one of ordinary skill in the art.

In an exemplary embodiment, the pump assembly 126 includes a motor 136, a gear box 138, a transfer case 140, and a pump body 142. The pump body 142 includes a pumping element in communication with a reservoir 144 that contains a fluid. A drain actuator 146 extends from the pump body 142. Operation of the motor 136 drives the pumping element through the gear box 138 and the transfer case 140. The pumping element displaces a first fluid (not shown) from the reservoir 144, causing moment of the first actuator 128 from an initial position. In the exemplary embodiment shown, the first actuator 28 includes a first ram 148 and a biasing member 150, for example a return spring that biases the ram 148 into the initial position. The movement of the first fluid overcomes the force of the return spring 150, causing movement of the ram 148 away from the pump body 142. The drain actuator 146 allows the first fluid to return to the reservoir 144, allowing the return spring 150 to bias the ram 148 into the initial position.

Figure 6:
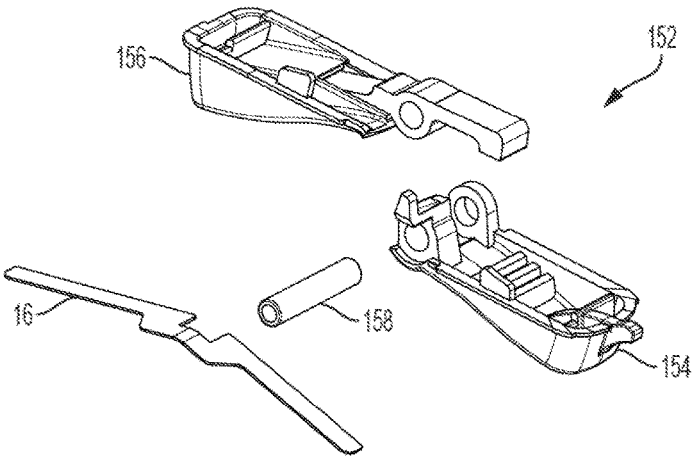
FIG. 6 is a perspective, exploded view of the exemplary trigger assembly of FIG. 5.

FIGS. 5 and 6 show an exemplary embodiment of a trigger 152 that can be connected to the handle 102. The trigger 152 includes a first button 154 and a second button 156. The first button 154 activates the motor 136 to advance the first actuator 128 and operate the tool 10. For example, when the first button 154 is depressed it engages a contact electrically connected to the motor 136, for example through the harness 134, to close a circuit and active the motor 136. The second button 156 can initiate the drain actuator 146, for example by manually contacting the drain actuator 146 and causing the first fluid to drain to the reservoir 144. The first and second buttons 154, 156 can be separately formed and pivotally connected to the housing through a pin 158 or sleeve. A leaf spring 160 biases the first and second buttons 154, 156 to a neutral or inactive position. Other types and configurations of triggers 152 can be used as would be understood by one of ordinary skill in the art.

Figure 7:
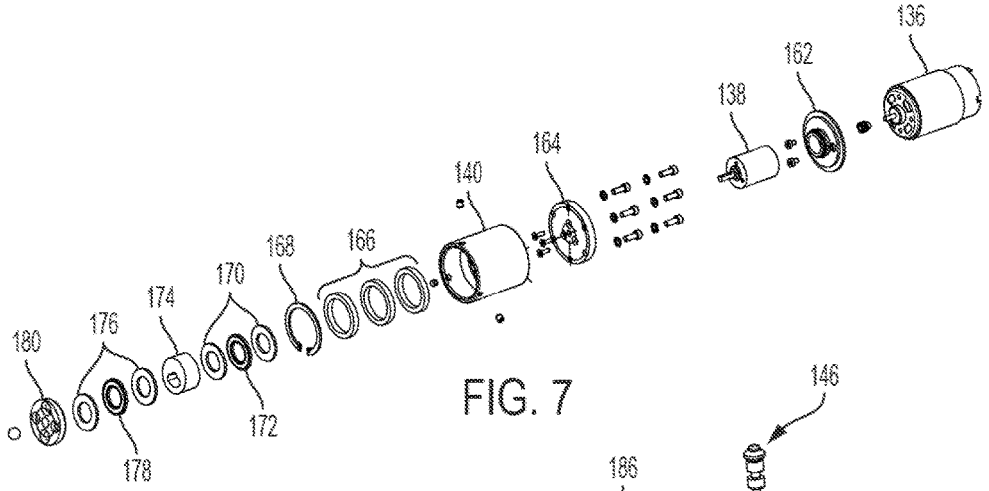
FIG. 7 is a perspective, exploded view of an exemplary motor, gear box and transfer case of a pump assembly.
Figure 8:
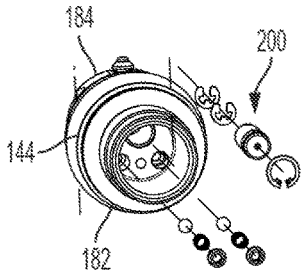
FIG. 8 is a front perspective, partially exploded view of an exemplary pump body.
Figure 9:
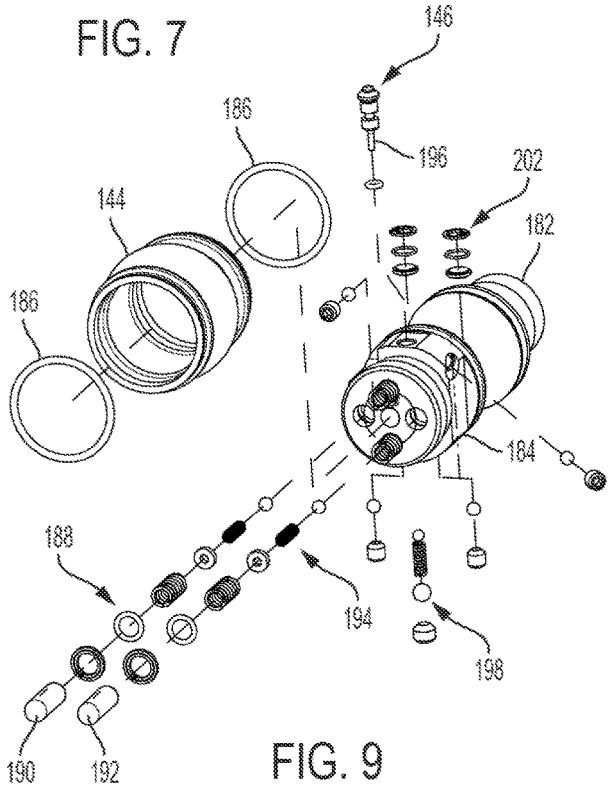
FIG. 9 is a rear perspective, partially exploded view of the exemplary pump body of FIG. 8.

FIGS. 7-9 depict an exemplary embodiment of a pump assembly 126. As best shown in FIG. 7, a rotary motor 136 is connected to the gear box 138 through a mounting plate 162. The transfer case 140 is connected to the gear box 138 through an interface plate 164. A series of first bearings 166, a retaining ring 168, a first set of washers 170, a second bearings 172, an angle plate 174, a second set of washers 176, a third bearing 178, and a wobble plate 180 are assembled inside the transfer case 140. As best shown in FIGS. 8 and 9, the pump body 142 includes a front section 182, a rear section 184, and the reservoir 144. In an exemplary embodiment, at least a portion of the reservoir 144 is positioned between the front and rear sections 182, 184. The reservoir 144 can also be positioned at least partially around a portion of the front and/or rear sections 182, 184. A first and second o-ring 186 seals the reservoir. A dual piston assembly 188 includes a first piston 190, a second piston 192 and a set of bearings, rings, springs, and washers, as would be understood by one of ordinary skill in the art. A pair of check valves 194, each including a spring and a ball can be positioned in-line with the pistons 190, 192.

The drain assembly is positioned in the rear section 184 and includes a drain pin 196 and a check valve 198 that includes a ball and a drain spring. By pushing the pin 196 down, for example through the actuator 146, the drain spring is depressed, unseating the ball and allowing fluid to flow into the reservoir 144. A relief valve 200 is positioned in the pump body 142 to prevent pressure from meeting or exceeding a threshold value. The pump body 142 can also include one or more filter elements 202. Different types, sizes, and configurations of pumps and motors can be used as would be understood by one of ordinary skill in the art.

Figure 10:
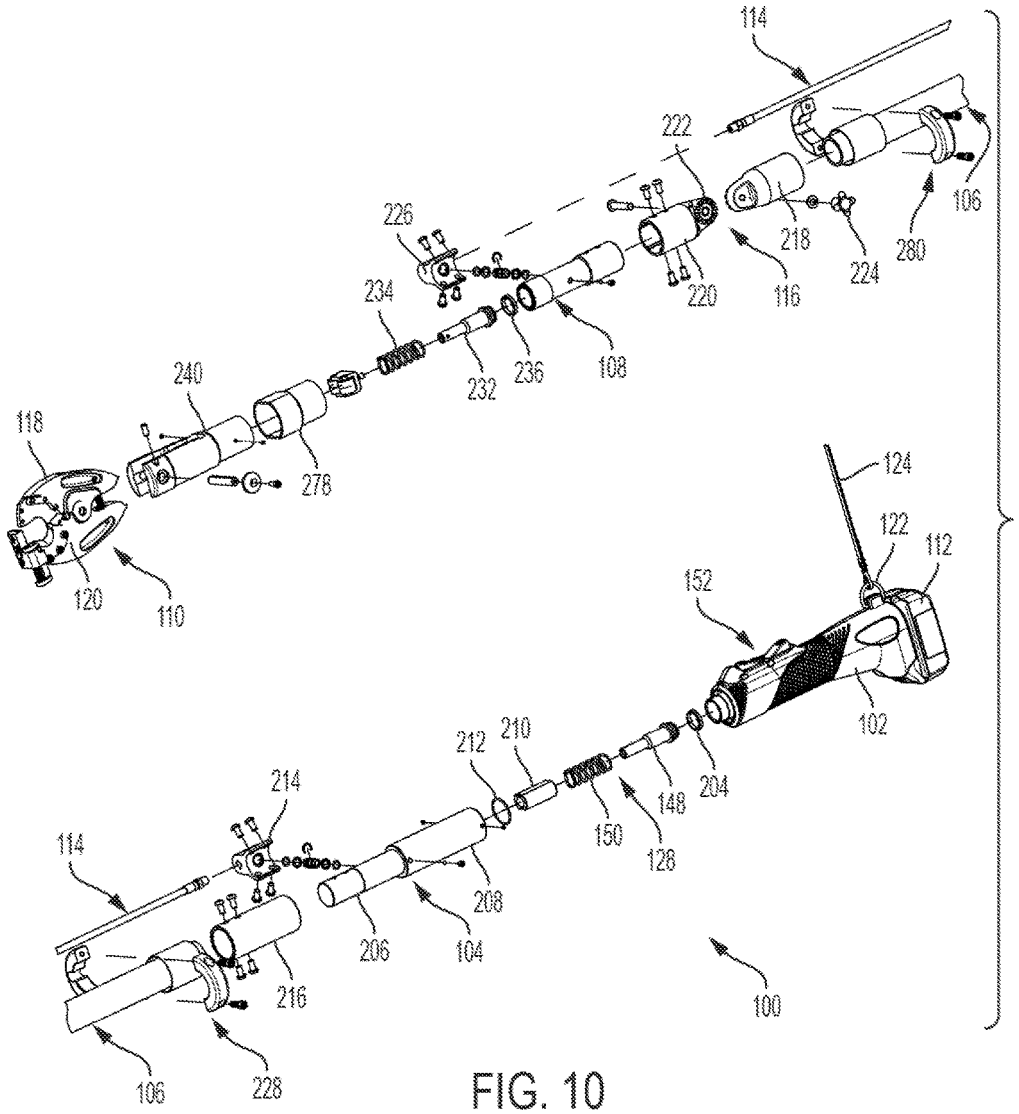
FIG. 10 is a perspective, exploded view of the exemplary hydraulic tool of FIG. 3.

FIG. 10 shows the components of the exemplary tool 10. The first actuator 128 extends from the handle 102 and is in contact with a first fluid on a first side and a second fluid on a second side. A seal 204, for example a flexible cup seal, is positioned on or around the first actuator 148 to assist in separating the first and second fluids.

The first actuator 128 extends into the first portion 104, which is depicted in this exemplary embodiment as a cylinder having a front section 206 and a rear section 208. In the exemplary embodiment, the rear section 208 has a first chamber that includes a portion of the second fluid (not shown) as well as a stop 210, the first return spring 150, and an o-ring 212. The stop 210 prevents over-travel of the first actuator 128 and the return spring 150 biases the first actuator 128, to an initial position. The rear section 208 also includes an opening (not shown) that is aligned with a first conduit connector 214, for example a right-angle connector. The first conduit connector 214 provides fluid communication between the rear section 208 and the fluid conduit 114 and also assists to secure the fluid conduit 114 to the tool body. The first conduit connector 214 has a curved surface that engages the outer surface of the first portion 104 and can be secured with one or more fasteners. Other types of connectors and fluid connections can be used to place the fluid conduit in fluid communication with the first portion.

The front section 206 of the first portion 104 can be solid or hollow as needed for strength requirements. A first adaptor 216 is connected to the front section 104, for example through one or more mechanical fasteners. The first adapter 216 receives the first end of the extension 106, for example a cylindrical tube. The extension 106 can be formed at any length to provide an overall desired length to the tool 100. In an exemplary embodiment, the extension 106 is made from fiberglass and filled with a foam material. The second end of the extension 106 is connected to the second portion 108, either directly or through another member, for example the pivot member 116. Different types, sizes, and configurations of extensions 106, including different materials, can be used as would be understood by one of ordinary skill in the art. In certain exemplary embodiments, the extension 106 is formed from a non-conductive material to assist in electrically isolating the handle 102 from the tool head 110.

The pivot member 116 is configured to connect to the extension 106 and the second portion 108. A mechanical connection, such as fasteners, an interference fit, snap fit, or other suitable connections, including adhesive connections can be used. The pivot member 116 includes a stationary member 218 and a moveable member 220 that can pivot with respect to stationary member about an axis. The stationary and moveable members 218, 220 can include a set of mating projections 222 that allow the moveable member 220 to be selectively positioned. The pivot member 116 can include a knob 224 that can be tightened or loosened to selectively secure the moveable member 220 to the stationary member 218. The moveable member 220 is connected to the second portion 108, for example through a mechanical and/or adhesive connection.

In an exemplary embodiment, the fluid conduit 114 runs along the extension 106 and connects at a second end to a second fluid connector 226. A first collar 228 and a second collar 230 help to retain the fluid conduit 114, although fewer or more collars can be used, including no collars. An opening provided in the second portion 108 is aligned with an opening in a second fluid connector 226, allowing fluid communication between a second chamber in the second portion 108 and the fluid conduit 114. The second fluid connector 226 can be another right-angle fluid connector or any suitable connection that provides fluid communication between the fluid conduit 114 and the second portion 108. In an exemplary embodiment, the fluid conduit 114 is a flexible member, for example a flexible hose. Different types of connections can be made between the fluid conduit and the first and second fluid connectors 214, 226, for example threaded, quick release, or snap fit connections. Any connection may be used that is sufficient to handle the pressure requirements of the system.

The second portion 108 includes a second chamber that receives the second actuator 232 and a second return spring 234. The second return spring 234 biases the second actuator 232 to an initial position, for example away from the tool head 110. A seal 236, for example a flexible cup seal, is placed around the second actuator 232 to retain the second fluid. The second actuator 232 extends into a second adaptor 238 that is connected to the second portion 108 and to a yoke 240. A roller 242 can be positioned in the second adaptor 238 to guide the movement of the second actuator 232. The tool head 110 is positioned in the yoke 240 and/or connected to the yoke 240. In an exemplary embodiment, the tool head 110 can be releasably connected to the yoke 240.

In operation, a user activates the trigger 152, actuating the pump assembly 126. The pump assembly 126 displaces the first fluid, moving the first actuator 128. Movement of the first actuator 128 causes movement of the second fluid through the fluid conduit 114. Movement of the second fluid causes movement of the second actuator 232 which causes operation of the tool head 110, for example closing the jaws 118, 120 to perform a cutting or crimping operation. After the operation is performed, the first fluid can be drained back into the reservoir 144, either automatically or by the user pressing the trigger 152 to engage the drain actuator 146. Draining the first fluid allows the first return spring 150 to bias the first actuator 1128 into the initial position and the second return spring 234 to bias the second actuator 232 in the initial position.

In an exemplary embodiment the second fluid is non-conductive. Moreover, the fluid conduit 114 and the extension 106 can be non-conductive, therefore electrically isolating the user end from the tool head 110. Isolating the first fluid and the second fluid also helps prevent the first fluid from being contaminated with metal particles over time as the tool is cycled. This helps increase the useful life of the tool 10 as the metal particles can damage the operation of the pump assembly 126.

Figure 11:
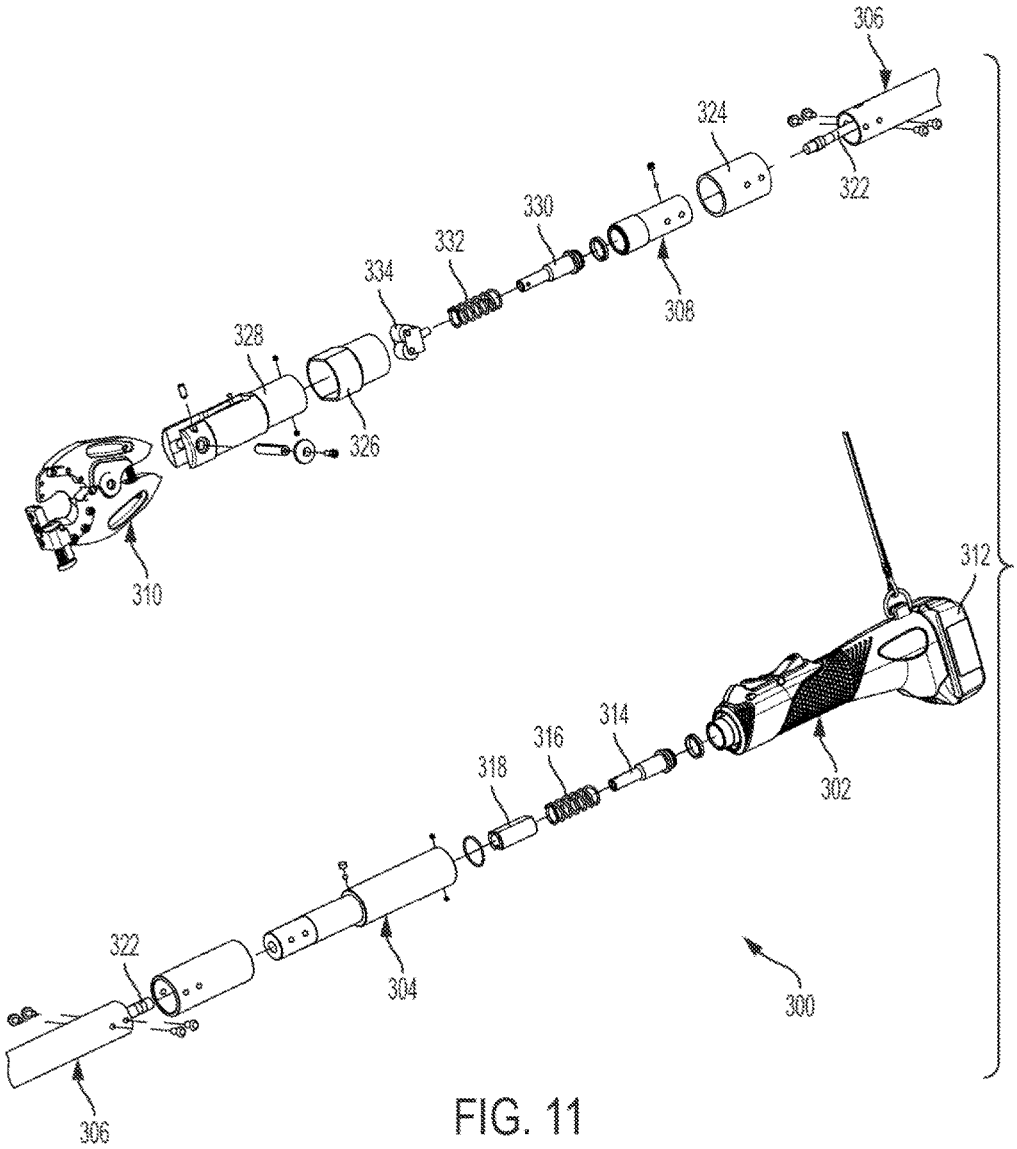
FIG. 11 is a perspective, exploded view of another exemplary hydraulic tool.

FIG. 11 depicts another exemplary tool 300. The tool includes a handle 302, a first portion 304 proximate the handle, an extension member 306, a second portion 308 distal from the handle 302, and a tool head 310. A battery 312 is connected to the handle to provide power to the tool 300. A first actuator 314 extends from the handle 302 into the first portion 304 which houses a first return spring 316 and a stop 318. A first adapter 320 connects the first portion 304 and the extension 306. A fluid conduit 322 runs through the extension member 306 from the first portion 304 to the second portion 308. A first end of the fluid conduit 322 is connected to the first portion 304 and extends through the first adaptor 320. A second adaptor 324 connects the extension 306 to the second portion 308. A second end of the fluid conduit 322 is connected to the second portion 308 so that the second portion 308 is in fluid communication with the first portion 304. A yoke adaptor 326 connects a yoke 328 to the second portion 308. A second actuator 330 extends from the second portion 308 through the yoke adaptor 326 and into the yoke 328. A roller 332 is configured to guide the second actuator 330 and a second return spring 334 biases the second actuator 330 toward an initial position. The second actuator 330 is operably connected to a tool head 310 to cause actuation of the tool head 310.

The tool can utilize a number of the same or similar components as described with respect to the tool in FIGS. 3-10. For example a similar pump assembly, various seals, fasteners, and connections can be used.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way. For example, various aspects of this disclosure can be incorporated into non-hydraulic tool assemblies and non-portable or non-handheld tools.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A hydraulic tool comprising:
a handle having a trigger;
a tool head for performing an operation;
a pump activated by the trigger to displace a first fluid;
a first actuator moveable by the displacement of the first fluid to displace a second fluid; and
a second actuator moveable by the displacement of the second fluid and operatively connected to the tool head,
wherein the first fluid is isolated from the second fluid.

2. The hydraulic tool of claim 1, wherein
a fluid conduit provides fluid communication between the first actuator and the second actuator.

3. The hydraulic tool of claim 2, wherein
the fluid conduit extends through a portion of a tool body.

4. The hydraulic tool of claim 2, wherein
the fluid conduit is connected to an outer surface of a tool body.

5. The hydraulic tool of claim 1 wherein
the conduit is connected to the first portion by a first connector and the second portion by a second connector.

6. A tool comprising:
a handle having a trigger;
a first actuator operatively connected to the trigger
a tool head;
an extension positioned between the handle and the tool head; and
a second actuator operatively connected to the first actuator and to the tool head,
wherein the extension is made from a non-conductive material and includes a hollow portion filled with a foam material.

7. The tool of claim 6, wherein
a first adapter connects the extension to the handle and a second adapter connects the extension to the tool head.

8. The tool of claim 6, wherein
a pump actuated by the trigger displaces a first fluid to cause movement of the first actuator and movement of the first actuator displaces a second fluid to cause movement of the second actuator.

9. The tool of claim 8, wherein
a conduit provides fluid communication between the first actuator and the second actuator.

10. A hydraulic tool comprising:
a handle having a trigger;
a tool head having a first jaw and a second jaw;
a tool body including a first portion, an extension, and a second portion positioned between the handle and the tool head;
a pump activated by the trigger to displace a first fluid;
a first actuator moveable by the displacement of the first fluid to displace a second fluid;
a second actuator moveable by the displacement of the second fluid to cause movement of at least one of the first and second jaws; and
a conduit providing fluid communication between the first actuator and the second actuator.

11. The hydraulic tool of claim 10, wherein
the first fluid is isolated from the second fluid.

12. The hydraulic tool of claim 10, wherein
a first portion of the first actuator is in contact with the first fluid and a second portion of the first actuator is in contact with the second fluid.

13. The hydraulic tool of claim 10, wherein
a first biasing member biases the first actuator to a first initial position and a second biasing member biases the second actuator to a second initial position.

14. The hydraulic tool of claim 10, wherein
the conduit is connected to the exterior of the tool body.

15. The hydraulic tool of claim 10, wherein
the tool head is pivotally connected to the tool body.

16. The hydraulic tool of claim 15, wherein
a pivot member is positioned between the extension and the second portion.

17. The hydraulic tool of claim 10, wherein
the pump includes a drain actuator operatively connected to the trigger.

18. The hydraulic tool of claim 17, wherein
operation of the drain actuator returns the first fluid to a reservoir.

* * * * *